US006238159B1

(12) United States Patent
Pappas

(10) Patent No.: US 6,238,159 B1
(45) Date of Patent: May 29, 2001

(54) KITCHEN CABINET INSTALLATION DEVICE (SP3)

(76) Inventor: Steve Pappas, 40 Hearth Stone Dr., Chesire, CT (US) 06410

( * ) Notice: Subject to any disclaimer, the term of this patent is extended or adjusted under 35 U.S.C. 154(b) by 0 days.

(21) Appl. No.: 09/519,432

(22) Filed: Mar. 6, 2000

(51) Int. Cl.[7] ..... B66B 9/16

(52) U.S. Cl. ..... 414/10; 187/244; 269/904; 414/800

(58) Field of Search ..... 187/244; 414/10, 414/800; 269/904

(56) References Cited

U.S. PATENT DOCUMENTS 4,482,130 * 11/1984 Paredes ..... 254/8 R
4,545,463 * 10/1985 Olovsson ..... 187/244
4,715,760 * 12/1987 Browning ..... 414/10
5,461,736 * 10/1995 Carpenter et al. ..... 187/244 X
5,542,500 * 8/1996 Emrey ..... 187/244 X
5,593,137 * 1/1997 Johnson ..... 254/122
5,626,206 * 5/1997 Weber et al. ..... 187/244
5,810,117 * 9/1998 Wood ..... 187/244

* cited by examiner

*Primary Examiner*—Janice L. Krizek

(57) ABSTRACT

A cabinet installation device includes cabinet support blocks slidably arranged on a pair of rails for providing controlled movement in either direction in the horizontal plane. The support blocks and the rails are supported on a rectangular piston that is vertically controlled by means of a hydraulic jack.

11 Claims, 2 Drawing Sheets

KITCHEN CABINET INSTALLATION DEVICE (SP3)

BACKGROUND OF THE INVENTION

The installation of cabinets and the like within kitchens is difficult for one person to accomplish in view of the size of the cabinets and the confines of the kitchen enclosure. Accordingly, two or more installers are required, one to position the cabinet intermediate the kitchen ceiling and the kitchen counter top or kitchen floor, and another to fasten the cabinet to the kitchen wall and ceiling.

U.S. Pat. No. 4,482,130 entitled "Vertical Lifting and Placing Apparatus" and U.S. Pat. No. 4,715,760 entitled "Hoist for Installing Cabinets, Ceiling Frames and the Like" describe sophisticated vertical lifting devices for supporting a cabinet while the installer is fastening the cabinet to the associated wall and ceiling.

A further problem associated with positioning such cabinets is the requirement to level and shim the cabinets prior to final installation. The use of vertical lifting devices, per se, does not readily allow such leveling and horizontal positioning of the cabinets.

One purpose of the invention is to describe a cabinet installation device that allows a sole installer to move the cabinet in the vertical and horizontal directions to level the cabinet to an exact position.

SUMMARY OF THE INVENTION

A cabinet installation device includes cabinet support blocks slidably arranged on a pair of rails for providing controlled movement in the horizontal plane. The support blocks and the rails are in turn supported on a rectangular piston controlled by means of an electric drill for providing controlled movement in the vertical plane.

DESCRIPTION OF THE PREFERRED EMBODIMENT

Figure 1:
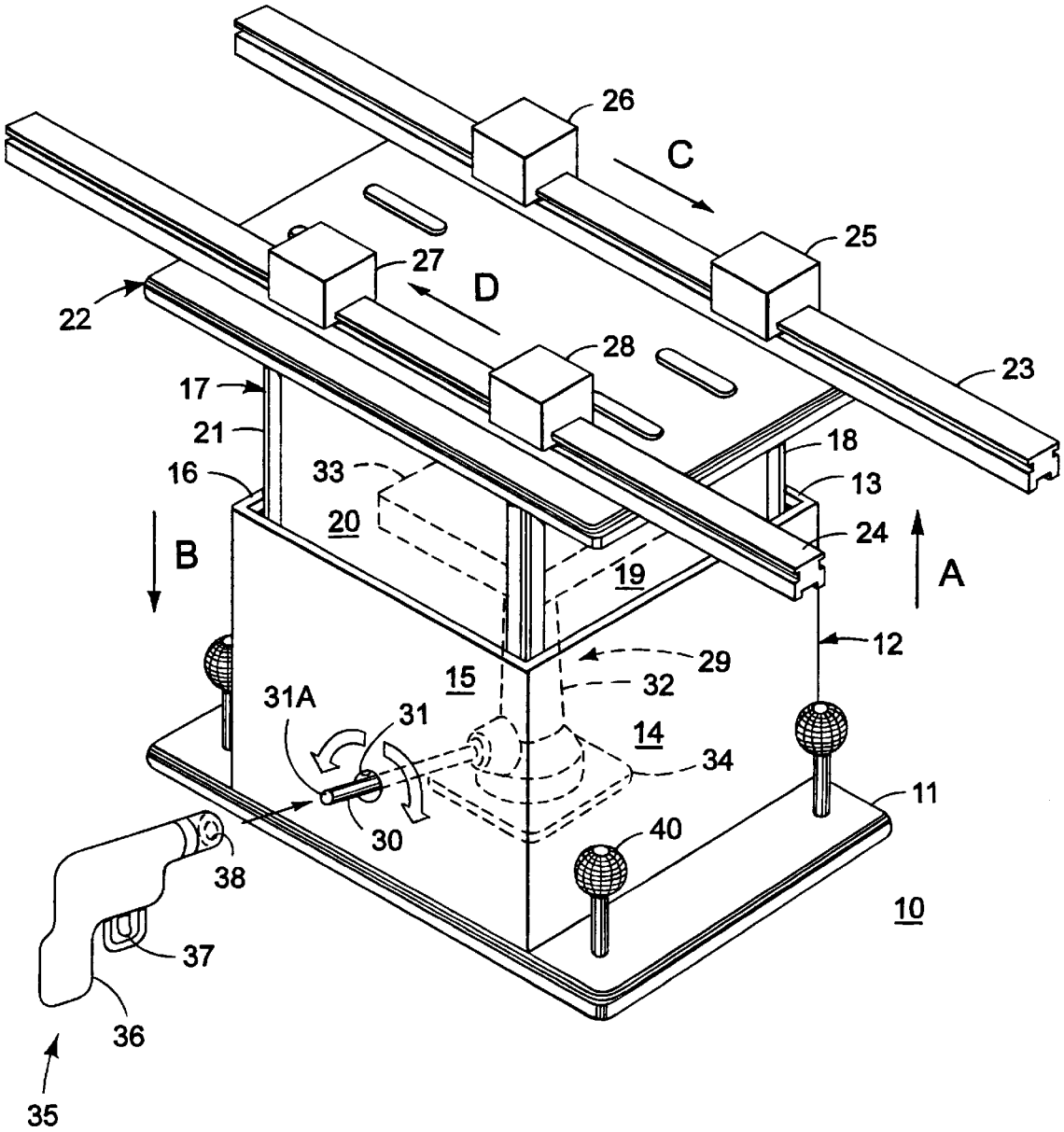
FIG. 1 is a top perspective view of the cabinet installation device according to the invention.

The installation device 10 is shown in FIG. 1 to include a base plate 11 to which a housing 12, including opposing sidewalls 13, 15 and 14, 16 are fixedly attached. A rectangular piston 17 including opposing sidewalls 18, 20 and 19, 21 and support plate 22 is positioned within the housing in clearance relation therewith. In accordance with the teachings of the invention, a hydraulic jack 29 is arranged within the housing and positioned such that the jack support plate 34 rests on the base plate 11 and the lift plate 33 is subjacent to the support plate 22. Operable access to the hydraulic cylinder 32, that operates the jack 29, is made by means of the drive shaft 30 extending through the aperture 31. An important feature of the invention is the removable connection between the end 31A of the drive shaft and the adjustable aperture 38 on the cordless electric power drill 35. Rotation of the shaft 30 in the clockwise indicated direction drives the rectangular piston 17 in the upward direction as indicated by the arrow A to the right of the device 10 whereas rotation of the shaft 30 in the counter-clockwise indicated direction returns the piston 17 in the downward direction as indicated by the arrow B to the left of the device.

The power drill 35 is a standard cordless electric drill having a grip handle 36 and control trigger 37 available to all cabinet installers.

A pair of parallel rails 23, 24 of an extruded aluminum alloy is fixedly attached to the top surface of the support plate 22 for transfer of the cabinet (not shown) when positioned upon the support blocks 25–28 that are slidably retained upon the rails 23, 24. Once the cabinet, or other work product, is positioned at the correct height prior to installation, the support blocks allow the cabinet to be moved in the horizontal plane as indicated by the arrows C, D for more exact positioning thereof.

Figure 2:
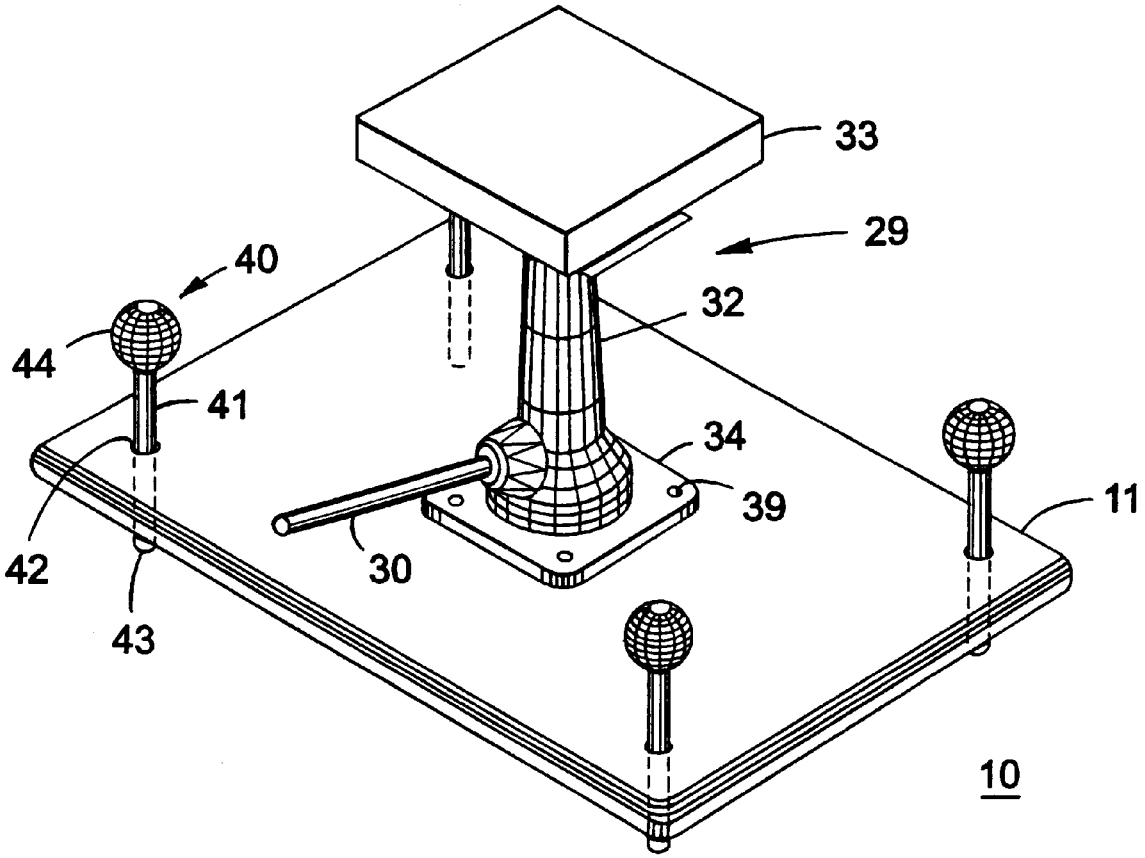
FIG. 2 is a top perspective view of the hydraulic jack and stabilizer adjusters used with the cabinet installation device of FIG. 1.

In further accordance with the invention, four stabilizers 40 are arranged on the base plate 11 for leveling the work product, in the manner best seen by referring to the device 10 depicted in FIG. 2 with the housing 12 and rectangular piston 17 removed therefrom.

The positional relationship of the jack 29 including the hydraulic lift cylinder 32, jack support plate 34 fixedly attached to the base plate 11 by means of rivets 39, drive shaft 30 and the lift plate 33 is dependent upon the positional relationship of the base plate. The stabilizers 40 installed at each corner of the base plate 11 include a manually accessible knurled end 44 to which an externally threaded shaft 41 is fixedly attached.

The shafts 41 extend through apertures 42 within the base plate that are internally threaded to receive the shafts for translation of the base plate whereby the ends 43 of the threaded shafts contact the floor or counter-top (not shown) of the installment location for tilting the support base and attached device 10 for more perfect alignment.

Once the cabinet is installed to the support wall and/or ceiling, the device 10 is removed by rotation of the shaft 30 in the counterclockwise direction by operation of the power drill 35, shown earlier in FIG. 1. Simultaneous movement of the cabinet in the horizontal and vertical directions is possible by retaining the power drill in one hand for moving the cabinet in either vertical direction, while using the other hand to move the cabinet along the rails 23, 24 (FIG. 1) in either horizontal direction. An installation device has been depicted herein for allowing the installation of kitchen cabinets and the like by a single operator without requiring supplemental equipment for leveling and positional accuracy.

What is claimed is:

1. A device for lifting and positioning kitchen cabinets comprising:

a housing;

rectangular means slidably arranged in said housing, said rectangular means having a support plate on a top of said rectangular means and a lift jack subjacent said rectangular means;

drive means extending from said jack and extending through said housing for access therewith to an electric power drill whereby said jack becomes activated for moving said rectangular means in a vertical direction and a pair of rails extending along said support plate; and a plurality of blocks slidably arranged on said rails, said blocks providing support for a cabinet.

2. The lifting device of claim 1 wherein a first pair of said blocks is positioned on one of said rails and a second pair of said blocks is positioned on another one of said rails.

3. The lifting device of claim 1 wherein said housing comprises opposing housing sidewalls defining a housing opening and said rectangular means comprises opposing rectangular sidewalls defining a piston.

4. The lifting device of claim 3 wherein said drive means extends through an aperture in one of said housing sidewalls.

5. The lifting device of claim 4 wherein said aperture is internally threaded.

6. The lifting device of claim 1 including a base plate on a bottom of said housing, whereby a bottom of said jack is attached to said base plate.

7. The lifting device of claim 6 including stabilizer means extending through said base plate, said stabilizer means including a threaded shaft for providing leveling adjustment to said base plate.

8. The lifting device of claim 7 wherein one end of said stabilizer means contacts a surface subjacent said base plate.

9. The lifting device of claim 8 wherein said stabilizer means includes a knurled surface at one end of said threaded shaft and one of said stabilizer means is arranged on each corner of said base plate.

10. A method for positioning a cabinet during installation comprising the steps of:

arranging a first pair of blocks slidably arranged on a first rail and a second pair blocks slidably arranged on a second rail;

positioning said first and second rails on a top part of a rectangular piston;

placing a lift jack under said rectangular piston;

supporting a cabinet upon said first and second pair of blocks; and energizing said lift jack for lifting said rectangular piston, said first and second pair of blocks, said first and second rails and said cabinet in a vertical plane.

11. The method of claim 10 including the steps of translating said cabinet along said first and second rails in a horizontal plane.

* * * * *